US006854285B2

(12) United States Patent
Jessen

(10) Patent No.: US 6,854,285 B2
(45) Date of Patent: Feb. 15, 2005

(54) CONTROLLER AND A METHOD FOR CONTROLLING AN EXPANSION VALVE OF A REFRIGERATION SYSTEM

(75) Inventor: Lars Mou Jessen, Nordborg (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 10/681,723

(22) Filed: Oct. 8, 2003

(65) Prior Publication Data

US 2004/0068999 A1 Apr. 15, 2004

(30) Foreign Application Priority Data

Oct. 8, 2002 (DK) ..... 2002 01504

(51) Int. Cl.[7] ..... F25B 41/04

(52) U.S. Cl. ..... 62/225; 62/212; 62/223; 236/92 B

(58) Field of Search ..... 62/222, 223, 224, 62/225, 210, 212; 236/92 B

(56) References Cited

U.S. PATENT DOCUMENTS

| | | | | |
|---|---|---|---|---|
| 4,364,238 A | | 12/1982 | Huelle et al. | |
| 4,617,804 A | | 10/1986 | Fukushima et al. | |
| 4,689,968 A | | 9/1987 | McCulloch et al. | |
| 4,807,445 A | | 2/1989 | Matsuoka et al. | |
| 5,157,934 A | | 10/1992 | Uchida | |
| 5,222,371 A | | 6/1993 | Doyama et al. | 62/204 |
| 5,259,210 A | | 11/1993 | Ohya et al. | |
| 5,271,238 A | * | 12/1993 | Powell et al. | 62/228.4 |
| 5,396,779 A | * | 3/1995 | Voss | 62/196.2 |
| 5,419,146 A | | 5/1995 | Sibik et al. | |
| 5,632,154 A | | 5/1997 | Sibik et al. | |
| 5,749,238 A | | 5/1998 | Schmidt | |
| 5,782,103 A | | 7/1998 | Schmidt | |
| 5,809,794 A | | 9/1998 | Sibik et al. | |
| 6,018,959 A | | 2/2000 | Schmidt | |

FOREIGN PATENT DOCUMENTS

| | | |
|---|---|---|
| DE | 196 47 718 A1 | 5/1998 |
| JP | 9287842 | 11/1997 |

* cited by examiner

*Primary Examiner*—Marc Norman
(74) *Attorney, Agent, or Firm*—McCormick, Paulding & Huber LLP

(57) ABSTRACT

A controller for an expansion valve of a refrigeration system for cooling a medium is configured to include, in the generation of a control signal, a measure of the evaporation temperature (T0) of the refrigerant in an evaporator and a measure of a property of the cooled medium, preferably without influence from a measure of the superheat temperature (SH) of the refrigerant. The controller comprises a PI-element for integrating and for producing a control signal for the expansion valve for controlling the flow of refrigerant into the evaporator, the PI-element being arranged in an inner control loop, a reference for which is produced by an outer control loop. The controller allows for fast response to disturbances and/or fast response of the medium temperature when the operating conditions of the refrigeration system are changed and/or fast response during start-up of the refrigeration system and maintains stable operation conditions with low, but positive superheating and a stable evaporation pressure.

11 Claims, 8 Drawing Sheets

CONTROLLER AND A METHOD FOR CONTROLLING AN EXPANSION VALVE OF A REFRIGERATION SYSTEM

CROSS-REFERENCE TO RELATED APPLICATIONS

This application is entitled to the benefit of and incorporates by reference essential subject matter disclosed in Danish Patent Application No. PA 2002 01504 filed on Oct. 8, 2002.

TECHNICAL FIELD

The present invention relates to the art of controlling a refrigeration system, more particularly to the art of controlling an expansion valve which controls injection of a refrigerant into an evaporator forming part of the refrigeration system. The refrigeration system further comprises at least one compressor and at least one condenser. The evaporator cools a medium, typically air or water. The expansion valve is typically electronically controllable. In the controller, there is usually associated one control unit and a number of sensors with the evaporator or, in the case of a system comprising several evaporators, with each of the evaporators. The sensors may register various selected temperatures and pressures of the cooled medium and refrigerant at different positions in the refrigeration system. The measured pressures and temperatures are used in a controller for controlling the injection of refrigerant into the evaporator in order to maintain stable operation conditions with low superheating out of the evaporator, while ensuring that the superheating never drops to zero.

BACKGROUND OF THE INVENTION

U.S. Pat. No. 5,782,103 discloses a control arrangement, wherein an evaporation pressure of the refrigerant is utilized as a feed-forward parameter. More specifically, the arrangement comprises a PID controller comprising a PI-element and a D-element which is connected in series with the PI-element. The PID controller controls an expansion valve, which in turn control the refrigerant flow from a condenser to an evaporator. A sensor is provided for measuring the temperature of the refrigerant at the inlet of the evaporator or the evaporation pressure in the evaporator. Another sensor measures the temperature of the evaporated refrigerant at the outlet of the evaporator, and a subtractor forms the difference between the two temperatures, i.e. the superheat temperature of the refrigerant. The superheat temperature is supplied as an input to the PI-element, whereas the temperature of the refrigerant at the inlet of the evaporator is supplied via a P-element to the D-element.

Further controllers for controlling expansion valve openings, in which a feedback signal representing the superheat, i.e. the temperature difference between the temperature of the refrigerant at the inlet of the evaporator and the temperature of the evaporated refrigerant at the outlet of the evaporator (or at the inlet of the compressor) are known from U.S. Pat. No. 5,749,238, U.S. Pat. No. 6,018,959, U.S. Pat. No. 4,689,968, U.S. Pat. No. 5,809,794, U.S. Pat. No. 4,807,445, U.S. Pat. No. 4,617,804, U.S. Pat. No. 5,157,934, U.S. Pat. No. 5,259,210, U.S. Pat. No. 5,419,146 and U.S. Pat. No. 5,632,154. Various PI-, PID- and fuzzy logic controllers have been suggested.

SUMMARY OF THE INVENTION

It is an object of the present invention to provide a controller and method that allows for faster reaction to disturbances or faster response of the temperature of the cooled medium when the operating conditions of the refrigeration system are changed or faster response during start-up of the refrigeration system. It is a further object of the invention to provide a controller which can maintain the refrigeration system in a stable operating condition with positive superheating (SH) and a stable evaporation pressure (P0), as it has been found that a stable evaporation pressure in conjunction with a low superheating ensures a high efficiency of the refrigeration system. Positive superheating also ensures that liquid refrigerant is not conveyed from the evaporator to the compressor. Preferred embodiments of the invention further aim at being able to regulate the refrigeration system down to low superheating at stable operating conditions and at being able to compensate for disturbances which may occur as a consequence of operational changes, such as increased load or operational changes to components of the refrigeration system, such as stepwise changes to the compressor capacity or condensing pressure, changes of temperature of the cooled medium or changes of flow rate of the cooled medium. It is desired that preferred embodiments of the invention allow for a swift and efficient regulation of the superheating down to a sufficiently low level in connection with start-up of the refrigeration system and that a positive superheating may be ensured in connection with correction for disturbances and during start-up. It is finally desired that adjustment of parameters of preferred embodiments of the controller of the invention may be performed based on simple adjustment rules.

Thus, the invention provides a controller for controlling a refrigeration system comprising a compressor, a condenser, an expansion valve and an evaporator, wherein the controller may control a degree of opening of the expansion valve on the basis of at least one measured parameter.

More specifically, the invention provides a controller and a method for controlling an expansion valve of a refrigeration system for cooling a medium, the refrigeration system having a refrigerant circulation and comprising at least one compressor, a condenser, an evaporator for evaporating a refrigerant and being arranged in series with the expansion valve, the expansion valve being electronically controllable by means of a control signal, the controller being configured to include, in the generation of the control signal, an output of a summing junction for summation or subtraction of a first and a second signal. According to the invention, the first signal is derived from at least a measure of the evaporation temperature (T0) of the refrigerant in the evaporator and a measure of a property of the medium, such as medium temperature at the inlet or outlet of the evaporator, or mass flow rate of the medium. In other words, the first signal is not influenced by a measure of the superheat temperature (the superheat temperature being also referred to as the superheat, the degree of superheat or the superheating). In the context of the refrigerant, the term "at an outlet of the evaporator" should be understood to be any location in a conduit for the refrigerant between the evaporator and the compressor.

It has been found that the superheat temperature generally responds relatively slowly during start-up of the refrigeration system and to disturbances or changes in operating conditions of the refrigeration system. Therefore, regulation in a controller in which integration is performed on a measure of the superheat temperature is also relatively slow. However, integration on a measure of the superheat temperature has hitherto been regarded as a common and entrenched way of providing a control signal for the expansion valve. It will thus be appreciated that the present invention comprises a new and inventive principle of controlling the expansion valve, as control is performed using a signal having a contribution which is not influenced by the superheat temperature as such, but rather on the evaporation temperature and a measure of a property of the cooled medium, thereby resulting in a more swiftly reacting regulation of the expansion valve.

It should be understood that the controller and method of the present invention may be implemented in hardware or software.

BRIEF DESCRIPTION OF THE DRAWINGS

The invention will now be further described with reference to the drawings, in which.

DETAILED DESCRIPTION OF THE PREFERRED EMBODIMENTS

Figure 1:
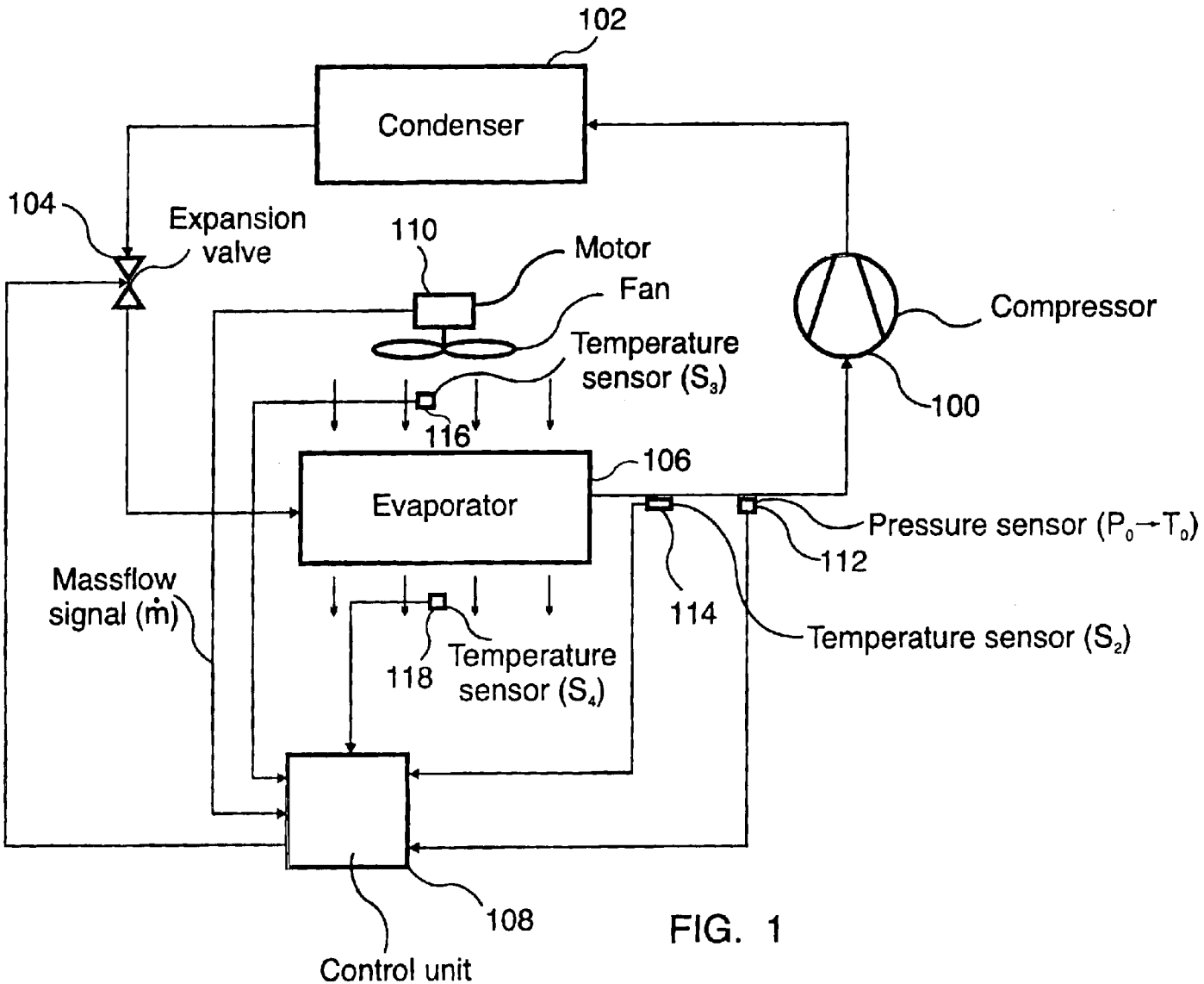
FIG. 1 is a diagrammatic illustration of a refrigeration system incorporating a controller according to the invention.

FIG. 1 shows a diagrammatic illustration of a refrigeration system, comprising a compressor 100, a condenser 102, an expansion valve 104, an evaporator 106, a control unit 108, a drive unit 110 for a medium to be cooled, and first, second, third and fourth sensors 112, 114, 116 and 118.

The first sensor 112 determines a pressure P0 in the evaporator, from which the evaporation temperature in the evaporator T0 is derived, i.e. the saturation temperature in the evaporator. Alternatively, the sensor 112 may be a temperature sensor for providing a measure of T0 directly, the temperature sensor being for example arranged in a pipe which is integrated in or connected to the evaporator 106 and which contains a mixture of refrigerant gas and refrigerant liquid.

The second sensor 114 determines the temperature S2 of the refrigerant at a refrigerant outlet of the evaporator. The sensor may for example be a temperature sensor which is in thermal contact with the flow of refrigerant out of the evaporator 106.

The third sensor 116 determines the temperature S3 of the cooled medium at a medium inlet of the evaporator 106.

The fourth sensor 118 determines the temperature S4 of the cooled medium at a medium outlet of the evaporator 106.

Finally, there may be provided means for determining a mass flow rate $\dot{m}$ of the medium to be cooled. For example, if the medium is conveyed by means of a circulation pump, a speed of rotation of the pump may be used as a measure of the mass flow rate.

Figure 2A:
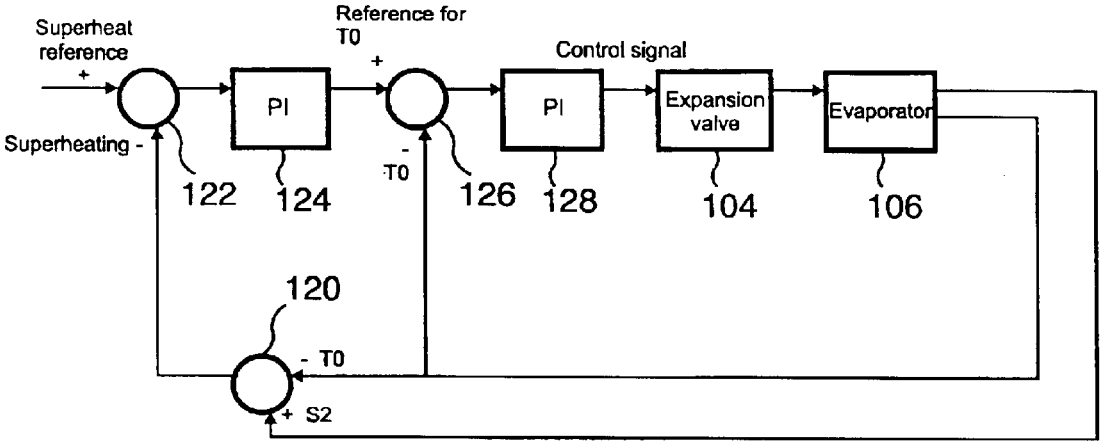
FIGS. 2*a* and 2*b* illustrate two embodiments of the controller of the invention, and their implementation in a control system.
Figure 2B:
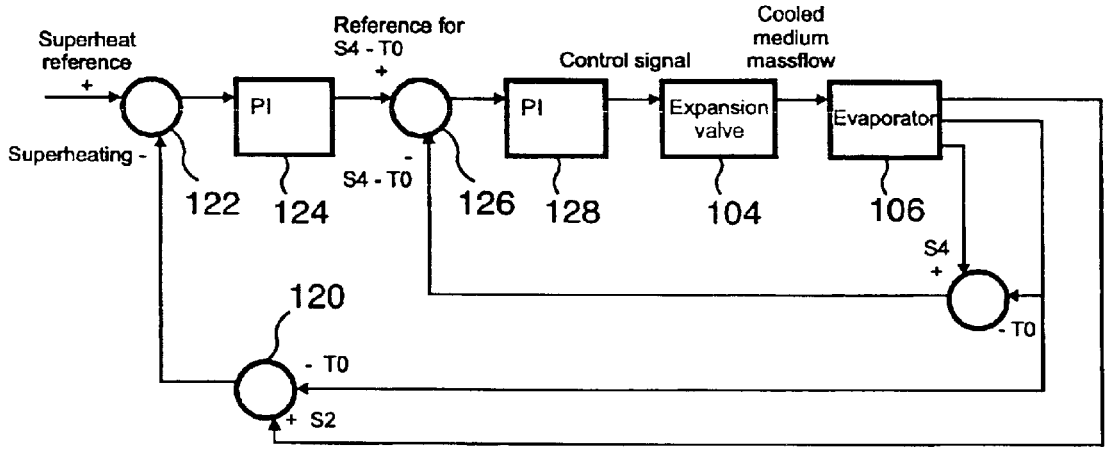
Figure 3:
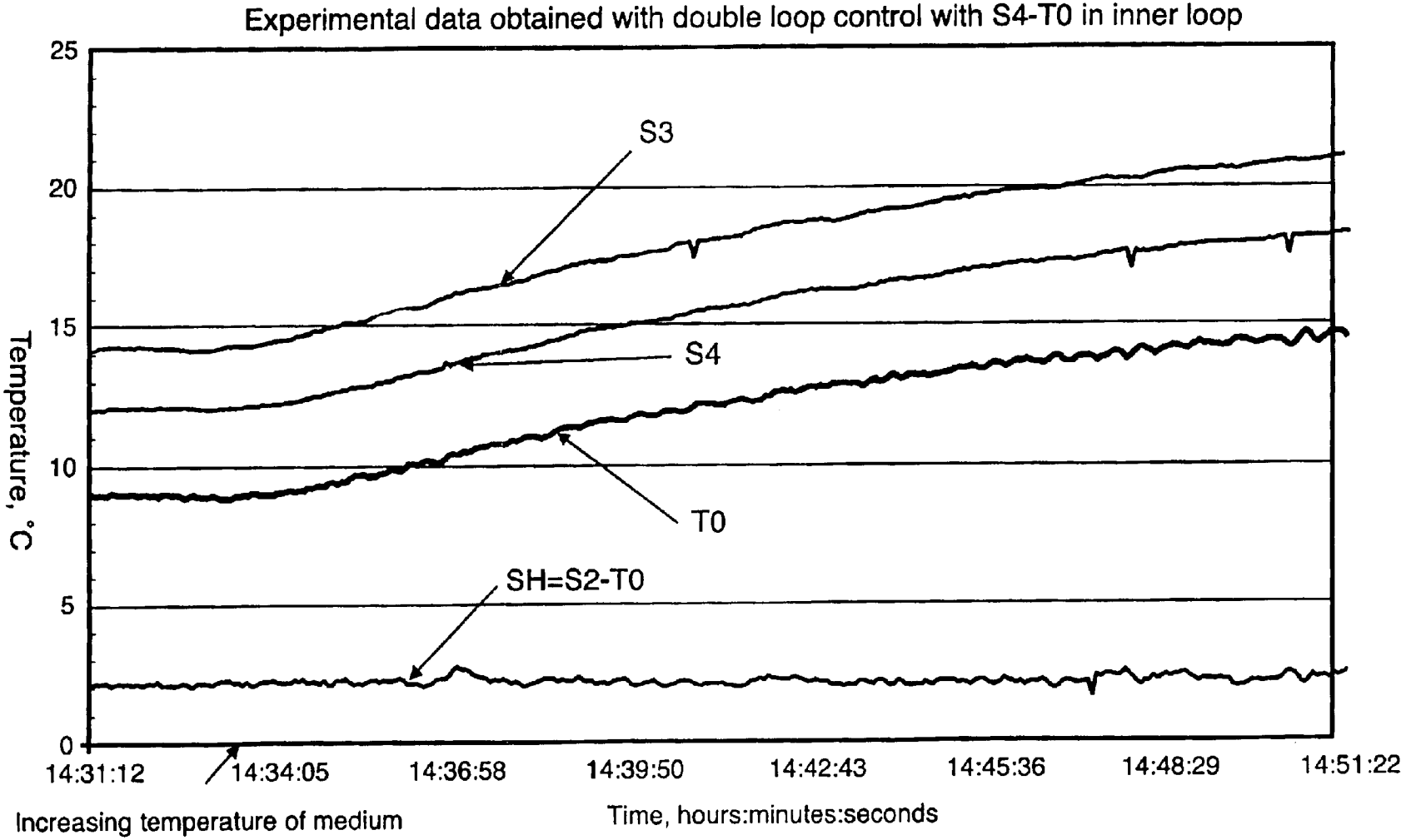
FIG. 3 illustrates measured temperatures and the superheat temperature of the refrigerant as a function of time in a refrigeration system incorporating a controller of the invention, in particular the response of the temperatures to a rising temperature of the cooled medium.
Figure 4:
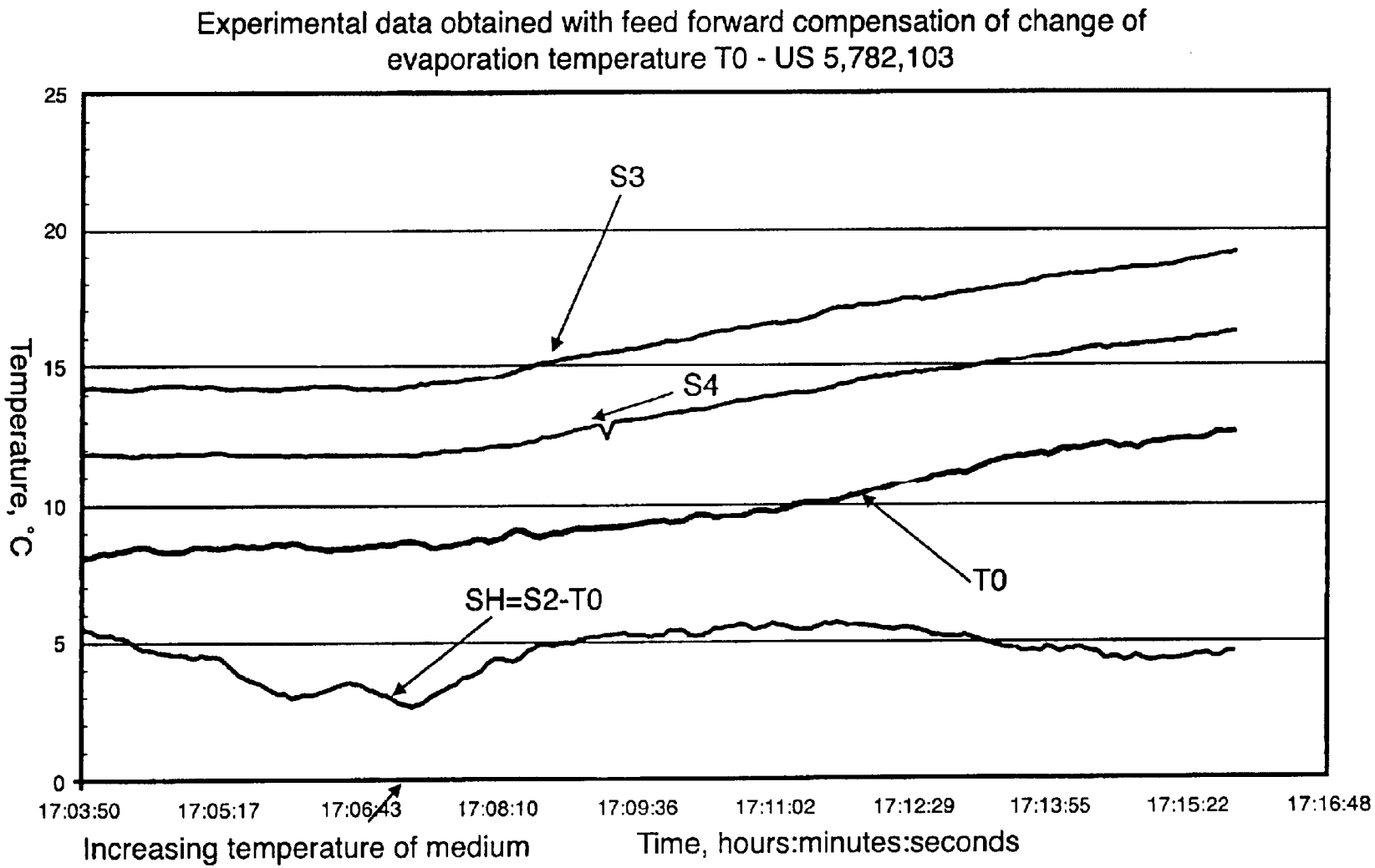
FIG. 4 PRIOR ART
FIG. 4 illustrates the temperatures of FIG. 5 as a function of time in a prior art refrigeration system.

Signals indicative of the determined pressure, temperatures and/or mass flow rate are provided to the control unit 108, in which they are processed to produce a control signal for the expansion valve 104, as illustrated in FIGS. 2*a* and 2*b*. The indication in FIGS. 2*a* and 2*b* that the sensor signals are obtained from the evaporator 106 should be understood so that the sensor signals are related to the evaporator. The evaporation temperature may for example be determined from a pressure sensor arranged in a pipe section at a distance from the refrigerant outlet of the evaporator. The signals related to the evaporator T0 and S2 are transmitted via appropriate signal conductors to a first summing junction 120, at which the difference S2–T0 is computed. This difference is a measure of the superheating or superheat temperature of the refrigerant at an outlet of the evaporator. A signal indicative of the superheat temperature is transmitted to a second summing junction 122, at which the difference between the determined superheat temperature and a reference superheat temperature is determined. This difference is used as an input signal for a first PI-element 124, an output of which is transmitted to a third summing junction 126 where it serves as a reference for the evaporation temperature signal. The measured evaporation temperature is also transmitted to the third summing junction 126, at which the difference between the measured evaporation temperature and the reference therefor is determined, the difference being provided as an input to a second PI-element 128. The output signal of the second PI-element 128 servers as a control signal for the expansion valve, which controls the flow of refrigerant into the evaporator.

As it appears from the above description and FIG. 2*a*, the controller comprises an inner and an outer control loop. The outer loop controls the reference of the inner loop based on the superheating S2–T0 and a reference of the superheat temperature. The inner loop controls the control signal to the expansion valve based the evaporation temperature and the reference which is provided by the outer loop. The inner loop makes use of the fact that the static amplification from the opening degree of the expansion valve to the evaporation temperature T0 as a function of the superheating is linear and well-defined, and that the dynamics in the controlling of the evaporation temperature is faster than the corresponding dynamics in the controlling of the superheating.

The controller of the invention may also include or operate with signals indicative of the capacity of the compressor, such as the number of activated steps, condenser capacity, condenser pressure or refrigerant temperature at an inlet to the expansion valve.

Moreover, the invention makes use of the finding that the dynamics in the control of the evaporation pressure (P0), which is a measure of the evaporation temperature (T0), may be significantly faster than the dynamics in the control of the superheating, in particular in a control element for integrating a feedback signal.

With the features and findings discussed above, preferred embodiments of the controller of the invention confer the below advantages. The tests forming the basis of the FIGS. 3–6 were performed on a water chiller with two separate refrigeration circuits, i.e. two systems, each with a reciprocating compressor with two capacity steps, an air cooled condenser and an evaporator, and a frequency converter associated with each condenser. In the chiller, the two evaporators were arranged in one common vessel. The evaporators were shell and tube evaporators with four refrigerant passes and one single common water side. The refrigerant was R407c, and the capacity of the chiller was 192.5 kW (55 TR).

It is possible to dimension the inner loop such that the evaporation pressure is controlled stably in the entire control spectrum, while it is possible to dimension a control in the outer loop which may control the superheating down to a low level. This results in a stable pressure and low superheating which again results in a high efficiency, see FIG. 3.

Frequently occurring disturbances as varying temperature of the cooled medium, stepwise changing of compressor capacity, stepwise changing of condenser capacity and varying mass flow rate of the medium to be cooled require little adjustment of the reference to the inner loop. Such disturbances are preferably compensated for by controlling in the inner loop. Due to the fast dynamics in the inner loop, disturbances are therefore compensated for swiftly.

It is possible to optimize the control parameters in the inner loop based on a simple determination (or measuring) of the static amplification and by the aid of parameter estimation, such as autotuning.

The control parameters to the outer loop are not dependent from the dimensioning of the expansion valve and may be determined by measuring of the static amplification characteristic. The control parameters in the outer loop are to a little degree dependent from the specific refrigeration system in which the controller is incorporated.

Analysis of the inner and outer loops have shown that the inner loop may be controlled significantly faster than the outer loop.

Based on information of the temperature of the medium to be cooled, it is possible to adjust the initial values of the reference to the inner loop at start-up to nearly optimal values. This results in a fast response/transition of the pressure (P0) and the superheating (SH), so that an optimal efficiency is obtained shortly after start-up.

In the present invention, the implementation of a MOP function (Maximum Operating Pressure, setting an upper limit for the evaporation pressure) may serve as a limitation on the reference to the inner loop and thereby as an upper limit for T0, $\mathbf{T0}_{max}$. The limit for T0 may be applied to the output signal of the first PI-element 123, so that if the output exceeds $\mathbf{T0}_{max}$, then the T0-reference to the summation junction 126 is set as $\mathbf{T0}_{max}$.

In particular, preferred embodiments of the controller of the present invention solve the following problems which are believed to exist in the controller disclosed in U.S. Pat. No. 5,782,103:

The amplification parameter in the inner loop is difficult to adjust correctly, because it depends on the step size of the compressor arrangement.

The adjustment of the amplification parameter in the superheating control varies from one refrigeration system to another and is dependent from the dimensioning of the expansion valve.

By changes in the temperature of the cooled medium, the opening degree of the expansion valve is compensated in a wrong direction, which leads to overshoot in the superheating. For example, at increasing medium temperature, the opening degree should be increased in order to maintain the superheating constant. However, the sign of the amplification factors in the feed-forward signal result in decreasing opening degree at increasing medium temperature and thereby an overshoot in the superheating, see FIG. 4. This is normally also the case in the controller of FIG. 2*a*, but the problem may be solved by taking into account the temperatures of the cooled medium (or medium to be cooled) at the inlet or outlet of the evaporator, as shown in FIG. 2*b*, see also the below description.

At changes in the mass flow rate of the medium to be cooled, the opening degree is also compensated in a wrong direction, which implies a risk of a liquid flow to the compressor. This problem may be solved by taking into account the temperature of the cooled medium (S4) at the outlet of the evaporator, see FIG. 2*b*.

Figure 5:
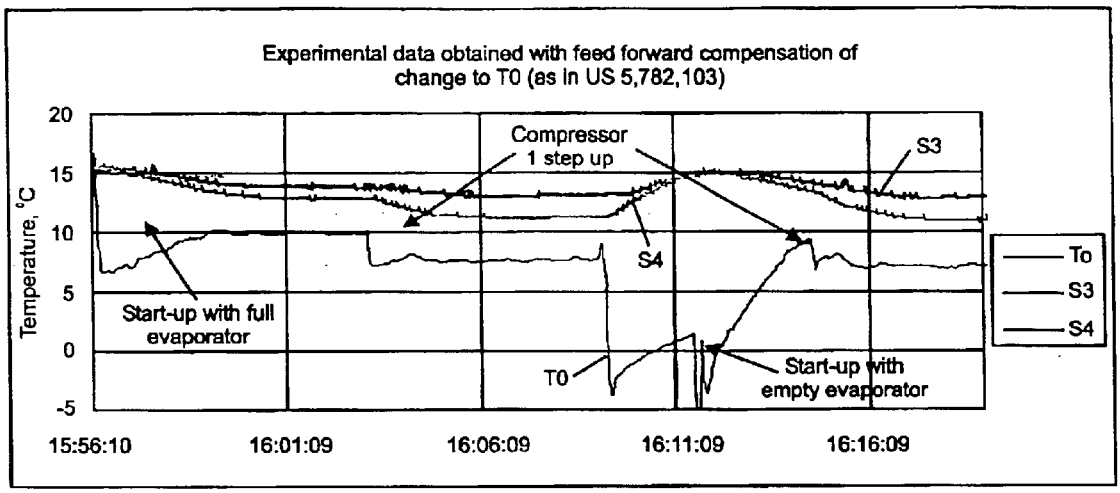
FIG. 5 PRIOR ART
FIG. 5 illustrates measured temperatures and superheat temperature as a function of time in a prior art system at two different start-up conditions.
Figure 5:
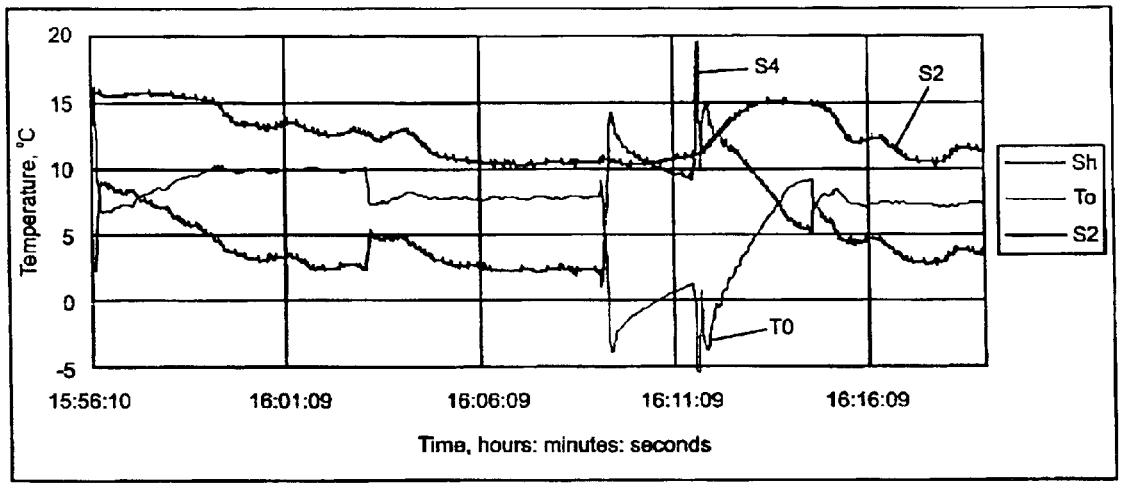
FIG. 5 PRIOR ART

Initial controlling toward a stable operational condition is generally slower, as the effect of integration in the controlling is solely present for the superheating signal, see FIG. 5.

Figure 7:
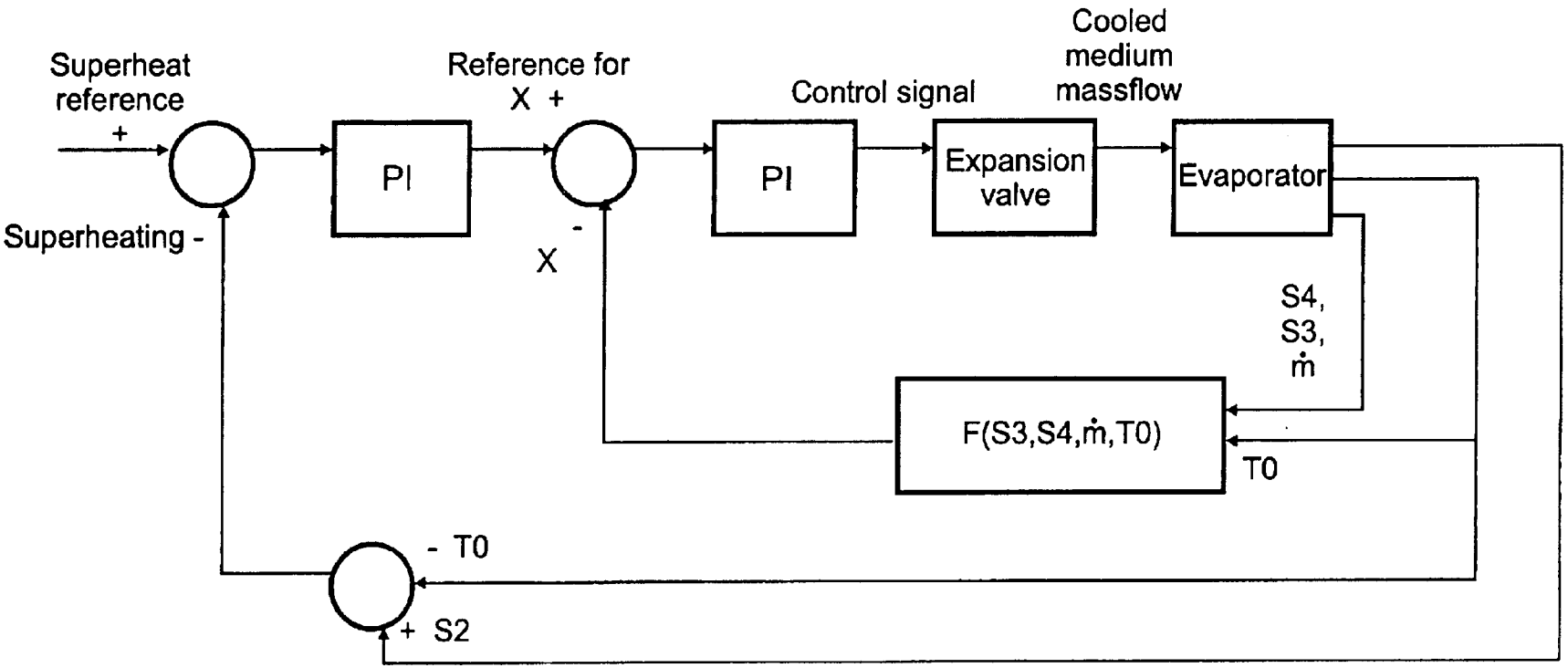

Though FIG. 2*a* illustrates a controller, in which the controlling in the inner loop is solely performed based on the evaporation temperature, the controlling in the inner loop may also be achieved by combining controlling of T0 (FIG. 2*a*) with one or more of the following parameters: the temperature of the medium to be cooled at an inlet to the evaporator (S3), the temperature of the cooled medium at an outlet of the evaporator (S4), cf. FIG. 2*b*, a measure of the mass flow rate of the medium to be cooled through the evaporator ($\dot{m}$). These variations are also indicated in FIG. 7.

Figure 6:
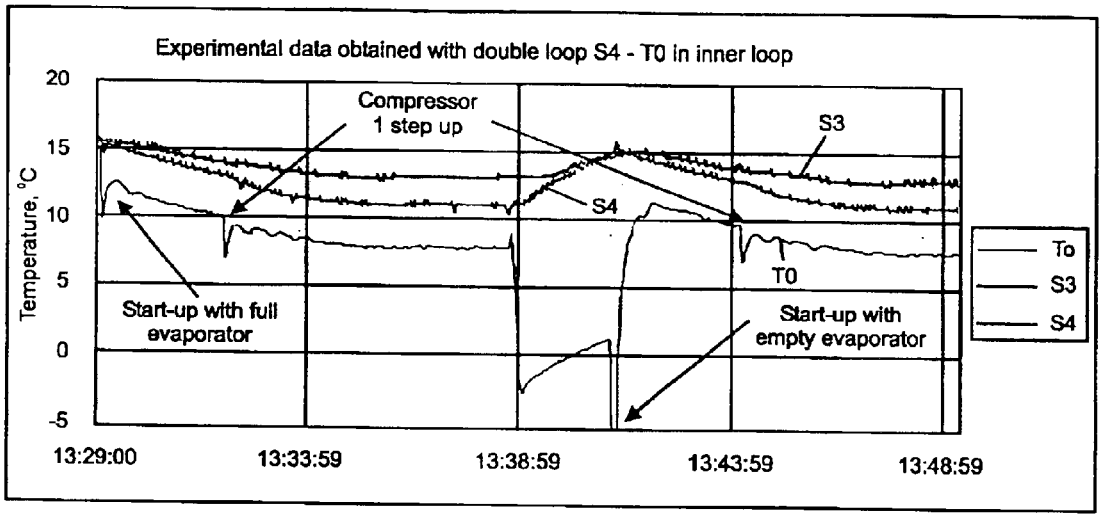
FIG. 6 illustrates the temperatures of FIG. 7 as a function of time in a system according to the invention, FIGS. 7 and 8 contain diagrammatic illustrations of further embodiments of the controller of the invention, and their implementation in a control system.
Figure 6:
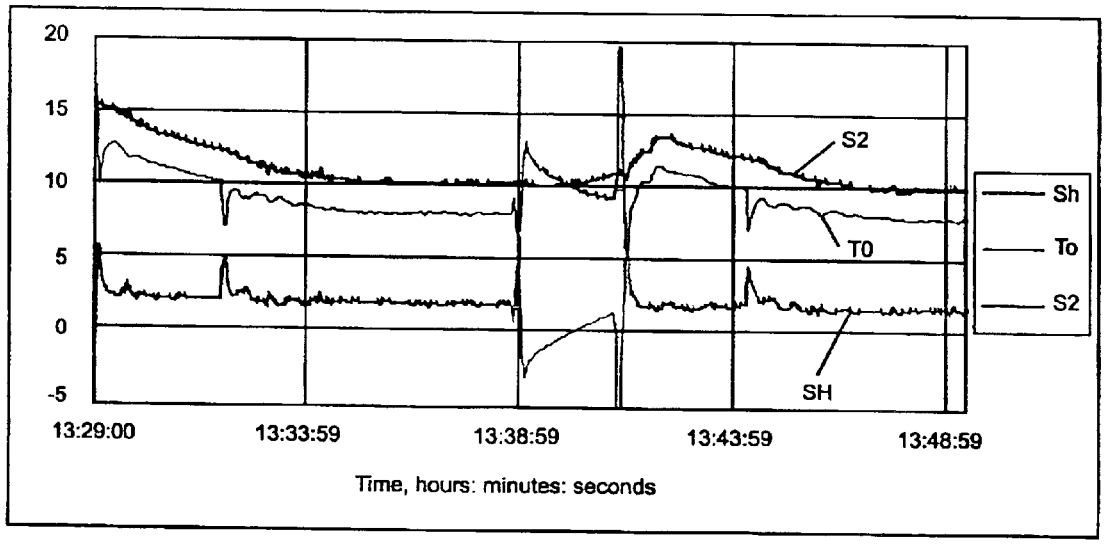

FIG. 6 shows the performance of a controller as shown in FIG. 2*b* at start-up with a full evaporator and at an upward shift of compressor step. A comparison between the curves for the superheating SH and the evaporation temperature T0 and the corresponding curves of FIG. 5 reveals that the controller of FIG. 2*b* compensates significantly faster for the disturbances than the controller of U.S. Pat. No. 5,782,103 does.

Figure 8:
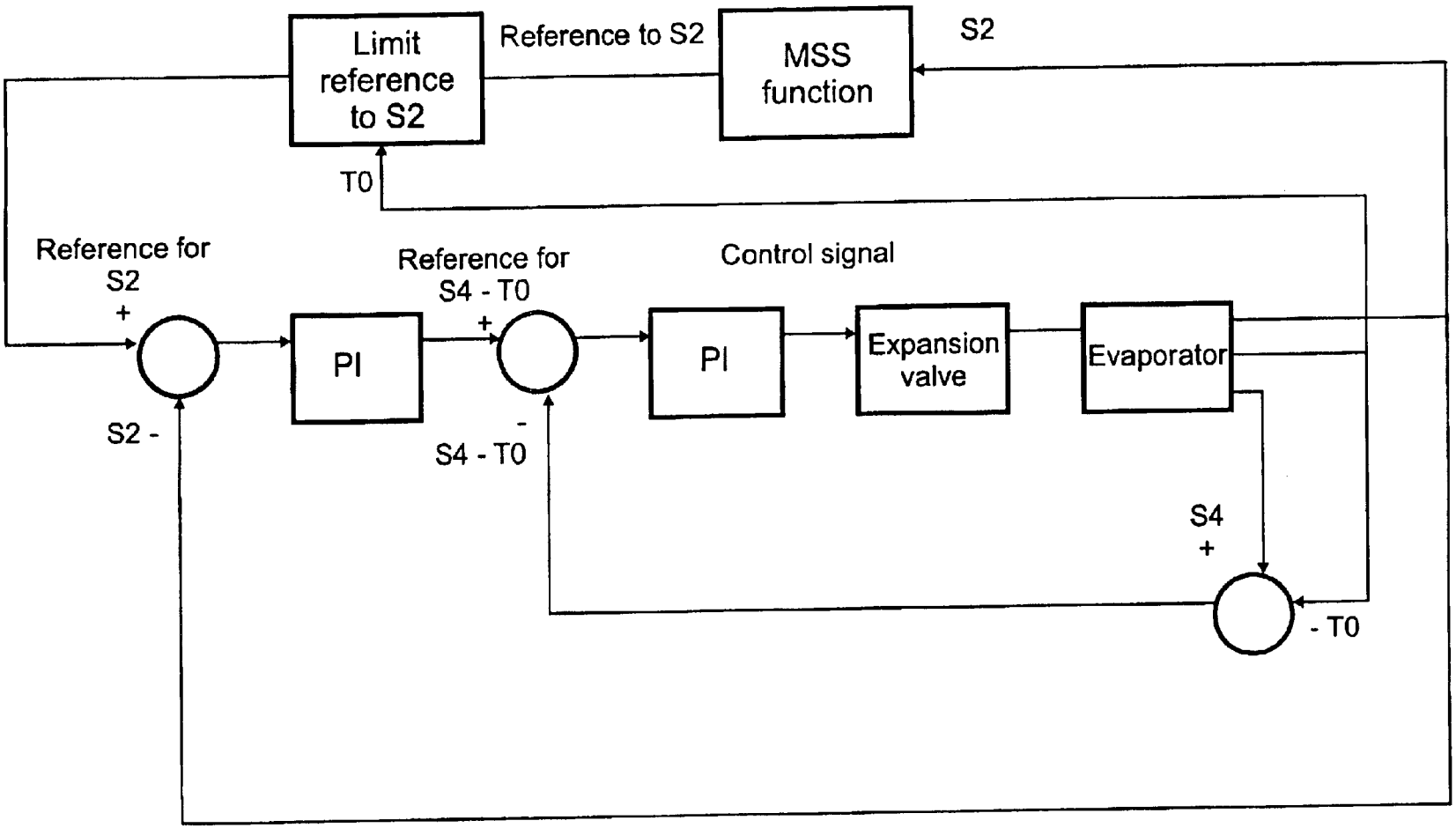

The reference to the outer loop may be controlled based on the standard deviation of the refrigerant temperature out of the evaporator, analogously to the method disclosed in U.S. Pat. No. 6,018,959. The reference to S2 may be limited based on the evaporation temperature in order to ensure positive superheating, see FIG. 8.

The expansion valve may comprise any suitable valve known per se, for example a step motor activated valve or a valve of the type disclosed in DE 196 47 718 and U.S. Pat. No. 4,364,238.

The PI-elements 124 and 128 (see FIGS. 2*a* and 2*b*) may be substituted by other types of appropriate control elements, such as PID-elements or fuzzy logic controllers. In the case of PID-elements, the effect of differentiating in the inner and outer loops, respectively, may be at least partially obtained from the feedback signal.

In the present invention, there may be provided a first and/or a second D-element for. The first D-element may be configured to generate the first signal or to contribute to the generation of the first signal. The second D-element may be configured to determine a derivative of the superheat signal (SH). Accordingly, an effect of differentiation may be achieved in the controller. The first D-element may preferably be provided so that it influences the first signal provided to the summation junction 126 but not the signal provided to the summation junction 122, and the second D-element may be provided so that it influences the signal provided to the summation junction 122 but not the signal to the summation junction 126.

What is claimed is:

1. A method for controlling an expansion valve of a refrigeration system for cooling a medium, the refrigeration system having a refrigerant circulation and comprising at least one compressor, a condenser, an evaporator for evaporating a refrigerant and being arranged in series with the expansion valve, the expansion valve being electronically controllable by means of a control signal, the method comprising including, in the generation of the control signal, an output of a summing junction for summation or subtraction of a first and a second signal, said first signal being derived from at least a measure of the evaporation temperature (T0) of the refrigerant in the evaporator and a measure of a property of the medium.

2. A controller for controlling an expansion valve of a refrigeration system for cooling a medium, the refrigeration system having a refrigerant circulation and comprising at least one compressor, a condenser, an evaporator for evaporating a refrigerant and being arranged in series with the expansion valve, the expansion valve being electronically controllable by means of a control signal, the controller being configured to include, in the generation of the control signal, an output of a summing junction for summation or subtraction of a first and a second signal, said first signal being derived from at least a measure of the evaporation temperature (T0) of the refrigerant in the evaporator and a measure of a property of the medium.

3. A controller according to claim 2, further comprising a first and a second control element, the first control element being configured to generate a contribution to an input for said summing junction, and wherein the second control element is configured to receive, as an input, the output of said summuning junction.

4. A controller according to claim 3, further comprising:

a further summing junction for subtracting the superheat temperature of the refrigerant (SH) from a reference superheat temperature, the superheat temperature (SH) being derived as the difference between the temperature (S2) of the refrigerant at a refrigerant outlet of the evaporator and said evaporation temperature (T0), S2–T0; the first control element being configured to receive, as an input, the difference between the reference superheat temperature and the superheat temperature or a signal derived from said difference, and to generate, as an output, said second signal.

5. A controller according to claim 4, comprising a second D-element for determining a derivative of the superheat signal (SH).

6. A controller according to claim 3, comprising an inner and an outer control loop, wherein the first control element is configured to generate a reference to the inner loop, and wherein the inner loop generates the control signal to the expansion valve based on said first signal and the reference generated by the outer loop.

7. A controller according to claim 3, wherein at least one of the first and second control element is constituted by one of the following elements:

a P-element;

an I-element;

a D-element;

a PI-element;

a PID-element;

a PD-element; and a fuzzy logic element.

8. A controller according to claim 2, and configured to include, in the derivation of said first signal, at least one of:

i) the temperature (S3) of the medium at a medium inlet of the evaporator;

ii) a measure of the mass flow of the medium ($\dot{m}$); and iii) the temperature (S4) of the medium at a medium outlet of the evaporator.

9. A controller according to claim 8, configured to derive the first signal by means of at least one of the following functions:

I) $\dot{m}\cdot(S3-S4)/\ln\{(S3-T0)/(S4-T0)\}$;

II) $(S3-S4)/\ln\{(S3-T0)/(S4-T0)\}$;

III) $S3-T0$;

IV) $S4-T0$.

10. A controller according to claim 2, comprising a first D-element for generating said first signal.

11. A refrigeration system comprising a controller according to claim 2.

* * * * *